US008235512B2

(12) United States Patent
Nakamura et al.

(10) Patent No.: US 8,235,512 B2
(45) Date of Patent: Aug. 7, 2012

(54) LIQUID CONTAINER AND LIQUID-EJECTING APPARATUS

(75) Inventors: Masahiro Nakamura, Shiojri (JP); Seiji Mochizuki, Shiojiri (JP); Yoshio Miyazawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 1051 days.

(21) Appl. No.: 11/701,199

(22) Filed: Jan. 31, 2007

(65) Prior Publication Data

US 2007/0176988 A1 Aug. 2, 2007

(30) Foreign Application Priority Data

Jan. 31, 2006 (JP) ..... 2006-023499

(51) Int. Cl.
*B41J 2/175* (2006.01)

(52) U.S. Cl. ..... 347/86

(58) Field of Classification Search ..... 347/84, 347/85, 86

See application file for complete search history.

(56) References Cited

U.S. PATENT DOCUMENTS

| | | | | |
|---|---|---|---|---|
| 6,106,112 | A * | 8/2000 | Okubo et al. | 347/86 |
| 6,270,210 | B1 * | 8/2001 | Yamaguchi et al. | 347/86 |
| 2005/0248637 | A1 * | 11/2005 | Seino et al. | 347/86 |

FOREIGN PATENT DOCUMENTS

| | | | |
|---|---|---|---|
| JP | 5016377 | A | 1/1993 |
| JP | 11-070665 | A | 3/1999 |
| JP | 2001-260390 | A | 9/2001 |

* cited by examiner

*Primary Examiner* — Laura Martin

(74) *Attorney, Agent, or Firm* — Nutter McClennen & Fish LLP; John J. Penny, Jr.; Christopher J. Stow

(57) ABSTRACT

A liquid container includes a liquid-containing bag filled with liquid and having a supply port that discharges the liquid; an outer frame accommodating the liquid-containing bag; a detecting plate fixed on the liquid-containing bag for detection of a liquid-exhausted state; and at least one protrusion disposed on the outer frame. The protrusion regulates transfer of the detecting plate in a direction along which the liquid-containing bag is compressed when the amount of the liquid remaining in the liquid-containing bag becomes small, and ensures a space through which the liquid can flow in the liquid-containing bag.

19 Claims, 9 Drawing Sheets

LIQUID CONTAINER AND LIQUID-EJECTING APPARATUS

The present application claims benefit under 35 U.S.C. §119 from Japanese Application No. 2006-023499 filed on Jan. 31, 2006, which is hereby incorporated by reference in its entirety.

BACKGROUND

1. Technical Field

The present invention relates to liquid containers and liquid-ejecting apparatuses.

2. Related Art

Liquid-ejecting apparatuses eject liquid supplied by liquid containers from ejecting heads to targets that face the ejecting heads. An example of such liquid-ejecting apparatuses includes ink-jet printers.

In some ink-jet printers, cartridges serving as liquid containers are not installed in carriages (so-called off-carriage type). Cartridges of the off-carriage type include ink packs formed of flexible film bags filled with ink and cases that accommodates the ink packs. The ink is supplied from the cartridges to the ejecting heads by differences in potential head with respect to the ejecting heads or by pressure to the ink packs using pressurized air.

Recently, consumption of ink in cartridges per unit time has been increasing due to, for example, increased printing speed of the ink-jet printers. In particular, large-format printers for business use consume great quantities of ink. Under such circumstances, the capacity of cartridges has been increasing.

In relation to this trend, slender cartridges have been proposed. The slender cartridges can have a larger capacity, and can also be installed in known printers. As shown in FIG. 11, a cartridge 100 includes a slender ink pack 101, a case 102 that accommodates the ink pack 101, and a cover 103 that covers the case 102. Moreover, a detecting plate 105 is stuck on the upper surface of the ink pack 101 for detecting a state where the ink level in the ink pack 101 reaches a predetermined value or lower (e.g., out-of-ink state). The detecting plate 105 has substantially the same length as the ink pack 101 in the longitudinal direction thereof, and includes a substantially L-shaped projection 106 at a side end thereof. Moreover, the detecting plate 105 is stuck on the ink pack 101 such that the projection 106 faces a through-hole 107 formed in the case 102.

As the ink inside the ink pack 101 is consumed, the ink pack 101 gradually collapses. With this, the detecting plate 105 moves in a direction along which the detecting plate 105 approaches the bottom surface of the case 102. When the ink is exhausted, the projection 106 of the detecting plate 105 enters the through-hole 107 of the case 102, and the projection 106 comes into contact with a detecting device (not shown) disposed below (in the drawing) the case 102. Thus, the detecting device detects the out-of-ink state of the ink pack 101.

However, when the size of the detecting plate 105 is not appropriately set, the detecting plate 105 may interrupt the flow of the ink inside the ink pack 101, and an out-of-ink state may be detected even when the ink level is higher than a predetermined value. To solve this problem, JP-A-2001-260390 discloses a cartridge for improving accuracy of detection by controlling the size of the detecting plate 105 on the basis of a ratio set according to the lengths of sides of the ink pack 101.

However, the cartridge disclosed in JP-A-2001-260390 is intended for use with detecting plates of known shapes. Therefore, when the above-described detecting plate 105 is adopted to a slender cartridge 100, the detecting plate 105 needs to be slender in accordance with the preset ratio. This can cause the attitude of the detecting plate 105 disposed on the flexible ink pack 101 to be unbalanced and unstable. Thus, a large load can be locally applied to the ink pack 101, and the initial value of water head with respect to the ejecting head can be increased. As a result, a normal ink meniscus cannot be formed at the nozzle of the ejecting head, thereby causing discharge failure. Furthermore, the ink can leak out from the nozzle at a time when the ink is not supposed to be discharged.

Moreover, the ink pack 101 can be easily creased when the detecting plate 105 is stuck on the ink pack 101. The creases formed during sticking of the detecting plate 105 to the ink pack 101 can hinder the transfer of the detecting plate 105, and can cause failure of detection of an out-of-ink state even when the ink level reaches a predetermined value or lower.

In contrast, when the size of the detecting plate 105 is reduced such that the detecting plate 105 is stably positioned on the ink pack 101, the portion on which the detecting plate 105 is stuck is compressed first. Thus, an out-of-ink state can be detected while the ink remains in portions on which the detecting plate 105 is not stuck.

SUMMARY

The invention provides a liquid container and a liquid-ejecting apparatus capable of improving accuracy of detection of a liquid-exhausted state and preventing detection failure.

According to an aspect of at least one embodiment of the invention, a liquid container includes a liquid-containing bag filled with liquid, and having a supply port that discharges the liquid; an outer frame accommodating the liquid-containing bag; a detecting plate fixed on the liquid-containing bag for detection of a liquid-exhausted state; and at least one protrusion disposed on the outer frame. The protrusion regulates transfer of the detecting plate in a direction along which the liquid-containing bag is compressed when the amount of the liquid remaining in the liquid-containing bag becomes small, and ensures a space through which the liquid can flow in the liquid-containing bag.

With this, when the liquid-containing bag having a small amount of remaining liquid is somewhat compressed by a change in the internal pressure or a load of the detecting plate, the liquid can flow via the space formed by the protrusion and can be discharged from the supply port.

The protrusion preferably includes a first protrusion and a second protrusion.

Since the detecting plate is supported by two protrusions, the space through which the liquid flows can be ensured even when the detecting plate is, for example, slender or wide.

The detecting plate preferably includes a detection projection that protrudes to the exterior of the outer frame via a window formed in the outer frame according to the inclination of the detecting plate when the liquid-containing bag is in the liquid-exhausted state. The first protrusion is preferably located closer to the detection projection than the second protrusion in a first direction substantially parallel to a side end of a fixed portion of the detecting plate fixed on the liquid-containing bag, wherein the side end has the detection projection. The second protrusion is preferably located closer to the detection projection than the first protrusion in a second direction substantially orthogonal to the first direction.

Thus, the portion having the detection projection can be easily inclined when the liquid is exhausted. Therefore, when the amount of the remaining liquid reaches a predetermined value or smaller, the detection projection protrudes to the exterior of the outer frame via the window, and a liquid-exhausted state can be reliably detected.

The first protrusion is preferably located at a position remote from the side end of the fixed portion of the detecting plate by a distance larger than half the width of the fixed portion, and smaller than or equal to three fourths of the width of the fixed portion.

With this configuration, detection of a liquid-exhausted state when the amount of the remaining liquid is large and detection failure when the amount of the remaining liquid reaches a predetermined value or smaller can be prevented.

The width of the second protrusion projected in the first direction is preferably in a range of half the width of the fixed portion of the detecting plate to four fifths of the width of the fixed portion.

With this configuration, detection of a liquid-exhausted state when the amount of the remaining liquid is large and detection failure when the amount of the remaining liquid reaches a predetermined value or smaller can be prevented.

The second protrusion is preferably inclined with respect to the second direction such that a first end of the second protrusion is closer to the supply port of the liquid-containing bag than a second end of the second protrusion in the first direction, and such that the second end is closer to the detection projection than the first end in the second direction.

With this configuration, the detection projection can reliably protrude to the exterior of the outer frame during a liquid-exhausted state.

The height of the first protrusion is preferably smaller than the height of the second protrusion.

With this configuration, the portion having the detection projection can reliably protrude to the exterior of the outer frame during a liquid-exhausted state.

The length of the detecting plate is preferably in a range of a quarter to half the length of the liquid-containing bag.

With this configuration, the attitude of the detecting plate can be stabilized even when the liquid-containing bag has, for example, a slender shape. Moreover, the liquid-containing bag can be prevented from becoming partly compressed by setting the length of the detecting plate to an appropriate value.

It is preferable that the liquid container further include adhesive portions disposed on the outer frame for fixing the liquid-containing bag.

These separate adhesive portions can more ably prevent the formation of creases in the liquid-containing bag. Thus, interruption of the liquid flow caused by the creases can be prevented.

According to another aspect of at least one embodiment of the invention, a liquid-ejecting apparatus includes an ejecting head for ejecting liquid; a liquid-supplying path for supplying the liquid contained in a liquid-containing bag to the ejecting head, a detecting plate being fixed on the liquid-containing bag for detection of a liquid-exhausted state; and at least one protrusion disposed at a position where the liquid-containing bag is installed. The protrusion regulates transfer of the detecting plate in a direction along which the liquid-containing bag is compressed when the amount of the liquid remaining in the liquid-containing bag becomes small, and ensures a space through which the liquid can flow in the liquid-containing bag.

With this configuration, when the liquid-containing bag having a small amount of remaining liquid is compressed by a change in the internal pressure or a load of the detecting plate, the liquid can be discharged from the supply port. Thus, the amount of liquid discharged from the liquid-containing bag can be increased.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
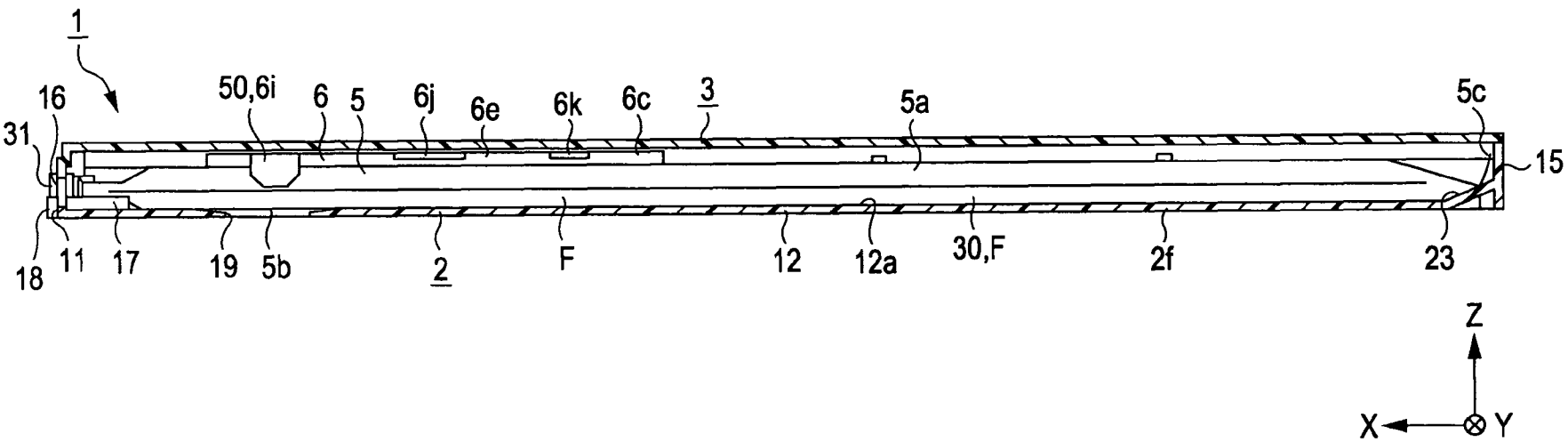
FIG. 1 is a longitudinal sectional view of a cartridge according to an embodiment of the invention.

A liquid container according to an embodiment of the invention, which serves as a cartridge to be installed in a printer serving as an off-carriage liquid-ejecting apparatus, will now be described with reference to FIGS. 1 to 10. FIG. 1 is a longitudinal sectional view of a cartridge 1, and FIG. 2 is a plan view of the interior of the cartridge 1.

Figure 2:
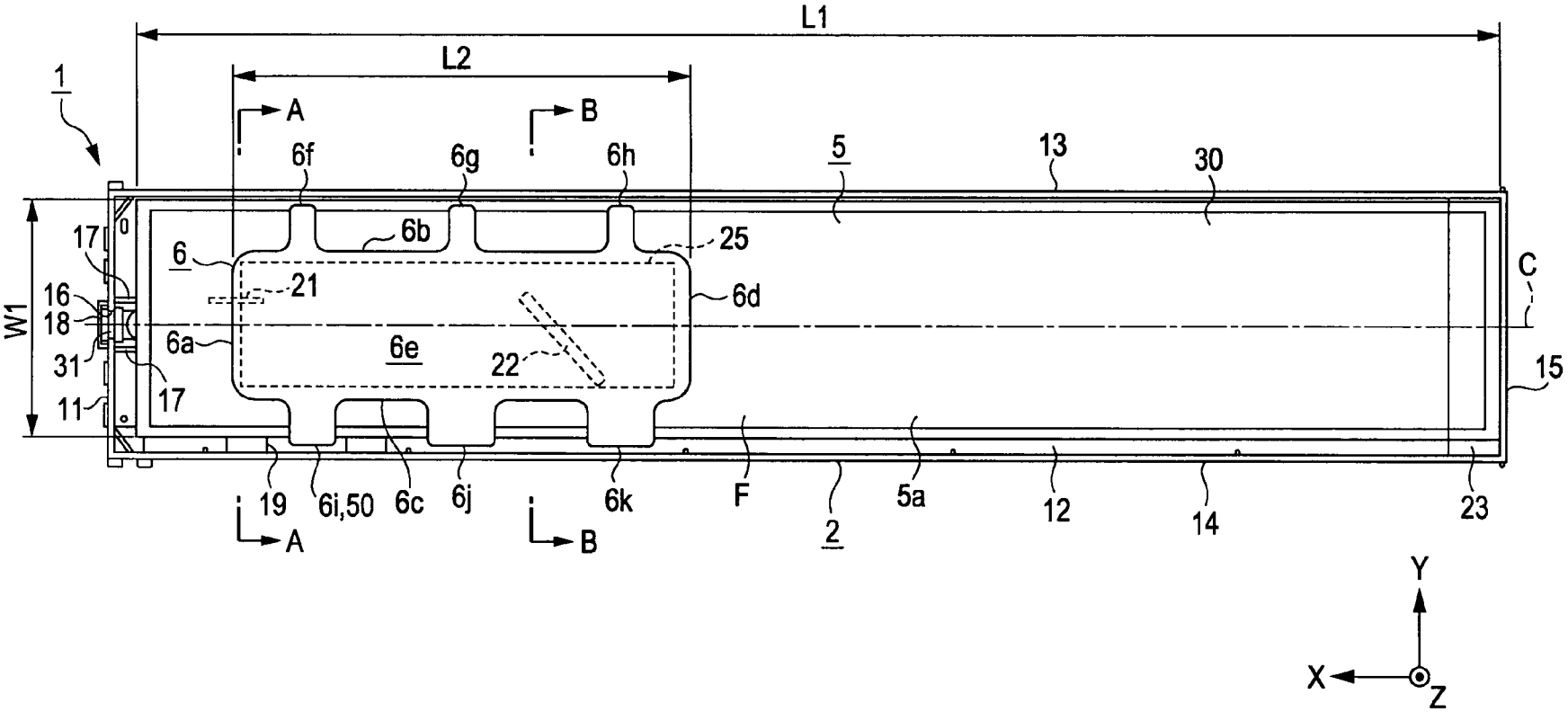
FIG. 2 is a plan view of the cartridge when a cover thereof is removed.

As shown in FIGS. 1 and 2, the cartridge 1 includes a box-shaped case 2 serving as an outer frame having an opening in the top thereof, a cover 3 that closes the opening of the case 2, an ink pack 5 serving as a liquid-containing bag accommodated in the case 2, and a detecting plate 6 stuck on the ink pack 5.

The cartridge 1 is connected to an ejecting head (not shown) of a printer via an ink-supplying mechanism including an ink-supplying path. In this embodiment, the cartridge 1 is disposed such that the cover 3 faces sideward. During printing, ink is supplied from the ink pack 5 to the ejecting head as the ink in the ejecting head is consumed.

First, the ink pack 5 accommodated in the case 2 will be described. As shown in FIG. 1, the ink pack 5 includes a slender bag portion 30 composed of a flexible film F and a supply port 31 for discharging the ink. The bag portion 30 is formed by welding the flexible film F having gas-barrier property, and is filled with ink. An end of the supply port 31 is fitted into an end of the bag portion 30 in the longitudinal direction. The supply port 31 is composed of a synthetic resin that can be welded to the inner side of the flexible film F. The supply port 31 is substantially cylindrical, and includes an elastic member (not shown) composed of rubber or the like inside the supply port 31 so as to seal the ink in the ink pack 5.

Next, the detecting plate 6 stuck on the ink pack 5 will be described. The detecting plate 6 is stuck on the upper surface 5*a* of the bag portion 30 of the ink pack 5 adjacent to the supply port 31. In this embodiment, a positioning mark (not shown) is printed on the ink pack 5, and the detecting plate 6 is stuck on the ink pack 5 in accordance with the positioning mark using a double-sided adhesive tape piece 25 shown in FIG. 2 such that the centerline of the detecting plate 6 is substantially aligned with the centerline C of the ink pack 5. As shown in FIG. 2, the detecting plate 6 includes a substantially rectangular body 6*e* (fixed portion), and the length L2 thereof (from the front end 6*a* to the rear end 6*d*) is in a range of a quarter to a half of the length L1 of the ink pack 5. Six protruding portions 6*f* to 6*k* extend outward from the left end 6*b* and the right end 6*c* of the body 6*e*. The width of the detecting plate 6 including the body 6*e* and the protruding portions 6*f* to 6*k* is substantially the same as the width W1 of the ink pack 5.

Moreover, the protruding portion 6*i* disposed most adjacent to the supply port 31 among the three protruding portions 6*i* to 6*k* formed at the right end 6*c* of the body 6*e* extends in a direction opposite to the direction of an arrow y, and then is bent in a direction opposite to the direction of an arrow z as shown in FIG. 1 so as to be formed in substantially an L shape. The end of the protruding portion 6*i* serves as a detection projection 50 for detecting an out-of-ink state.

Figure 3:
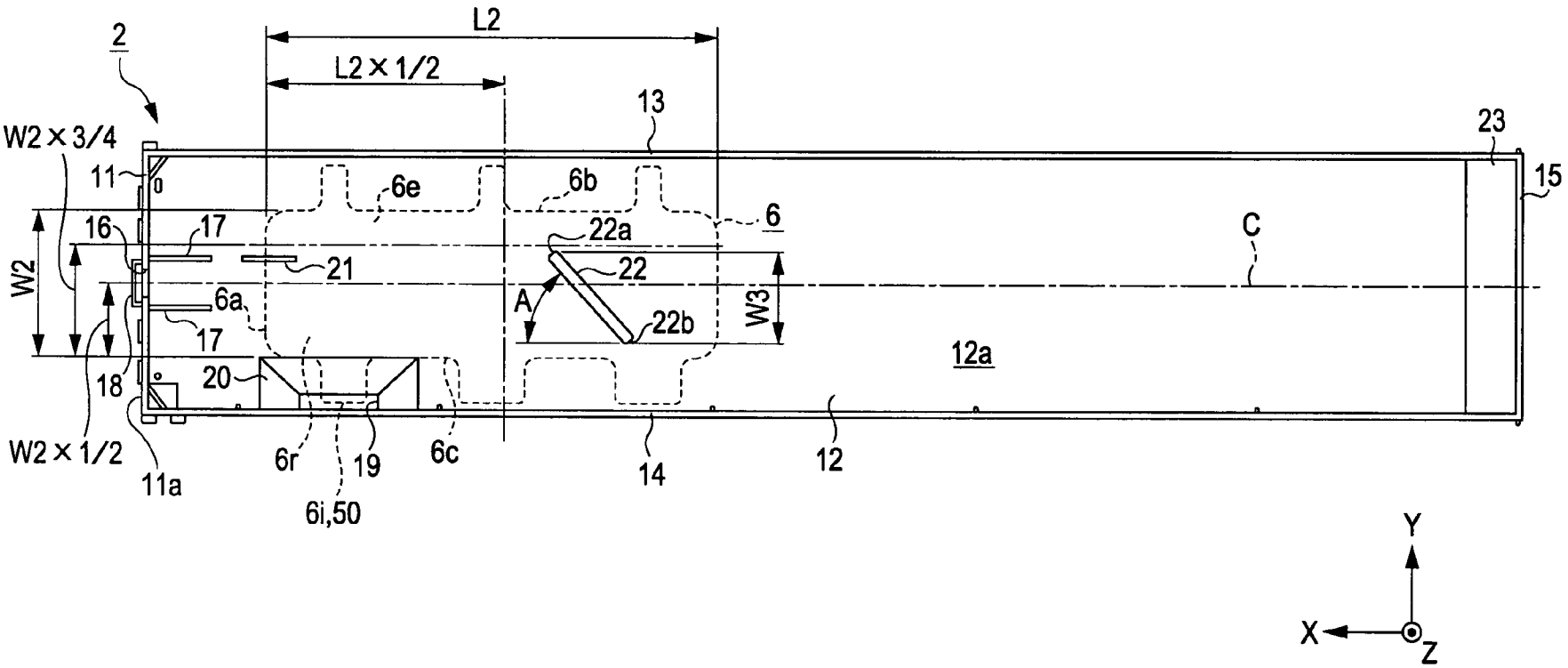
FIG. 3 is a plan view of a case constituting the cartridge.

Next, the case 2 will be described with reference to FIG. 3. FIG. 3 is a plan view of the case 2. The case 2 is a slender box having an opening in the top thereof. The case 2 is formed of a front wall 11, a bottom wall 12, a left wall 13, a right wall 14, and a rear wall 15, and the ink pack 5 is accommodated in a space enclosed by the walls 11 to 15. A through-hole 16 into which the supply port 31 of the ink pack 5 (see FIGS. 1 and 2) is fitted is formed in the center of the front wall 11 of the case 2. Moreover, a pair of first supporting portions 17 protrudes from the bottom wall 12 of the case 2 so as to have the through-hole 16 interposed therebetween. Furthermore, a second supporting portion 18 is disposed on the front surface 11*a* of the front wall 11 so as to cover the through-hole 16. The first supporting portions 17 and the second supporting portion 18 support the supply port 31 of the ink pack 5 fitted into the through-hole 16.

Moreover, a detection window 19 is formed in the bottom wall 12 of the case 2 adjacent to the right wall 14. The size of the detection window 19 is sufficiently large for the detection projection 50 of the detecting plate 6 stuck on the ink pack 5 to pass through the detection window 19. Furthermore, the case 2 has a tapered portion 20 inclined toward the detection window 19 at the bottom surface 12*a* thereof around the detection window 19.

Figure 4B:
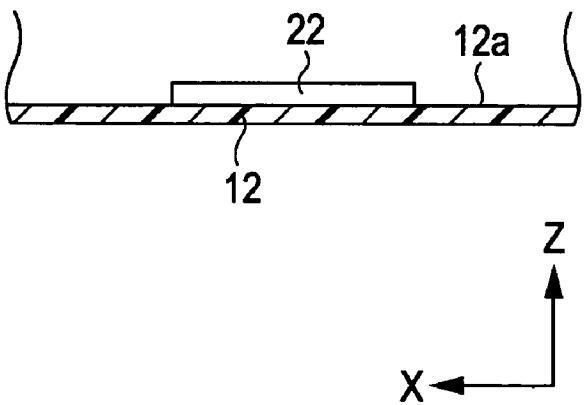
FIGS. 4A and 4B are enlarged views of a first protrusion and a second protrusion, respectively.
Figure 4A:
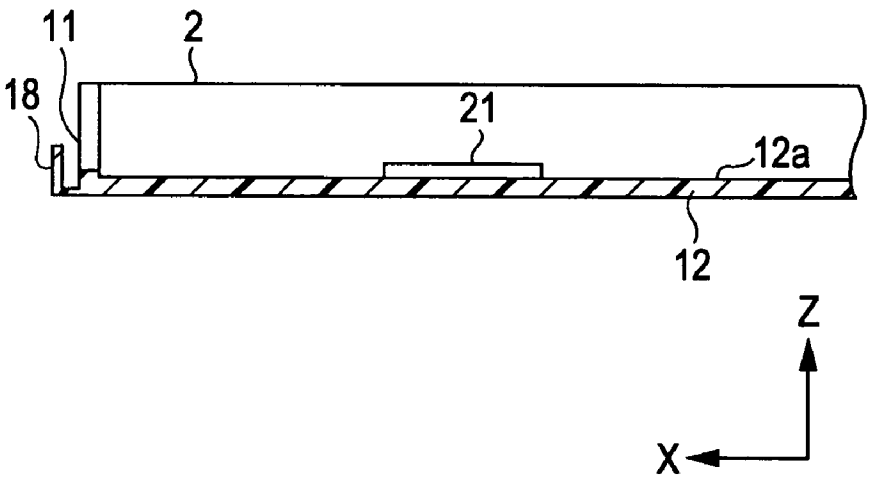

Furthermore, a tabular first protrusion 21 protrudes from the bottom surface 12*a* of the case 2 so as to be parallel to the left wall 13 and the right wall 14. As shown in FIG. 4A, the height of the first protrusion 21 is smaller than that of the front wall 11 of the case 2. Moreover, the first protrusion 21 is located closer to the front wall 11 of the case 2 in the longitudinal direction of the case 2 (a first direction; in the direction of an arrow x in FIG. 3) than the detection window 19. Furthermore, the first protrusion 21 is located at a side of the centerline C of the case 2 (the ink pack 5 and the detecting plate 6) opposite that on which the detection window 19 lies, i.e., adjacent to the left wall 13 in the lateral direction of the case 2 (a second direction; in the direction of the arrow Y).

More specifically, the first protrusion 21 is located at a position remote from the right end 6*c* of the rectangular body 6*e* fixed on the ink pack 5, the body 6*e* being a part of the detecting plate 6 stuck on the ink pack 5, by a distance larger than half the width W2 of the body 6*e* and smaller than or equal to three fourths of the width W2 ($\frac{1}{2}\cdot W2 <$ (position of the protrusion in the lateral direction) $\leqq \frac{3}{4}\cdot W2$).

Moreover, the first protrusion 21 is disposed so as to face the front end portion of the detecting plate 6 via the ink pack 5 when the ink pack 5 is accommodated in the case 2. With this, the attitude of the detecting plate 6 is stabilized.

Moreover, a tabular second protrusion 22 protrudes from the bottom surface 12*a* of the case 2 so as to be inclined with respect to the lateral direction of the case 2 (in the direction of the arrow y). As shown in FIGS. 4A and 4B, the height of the second protrusion 22 is smaller than that of the front wall 11 of the case 2, and larger than that of the first protrusion 21. Moreover, as shown in FIG. 3, the second protrusion 22 is located to be closer to the rear wall 15 in the longitudinal direction of the case 2 (in the direction of the arrow x) than the first protrusion 21 and the detection window 19. Furthermore, the second protrusion 22 is located at a position remote from the front end 6*a* of the detecting plate 6 by a distance approximately larger than or equal to half the length L2 of the detecting plate 6 and approximately smaller than or equal to the length L2 of the detecting plate 6. The left end 22*a* serving as a first end of the second protrusion 22 is adjacent to the front wall 11, and the right end 22*b* serving as a second end of the second protrusion 22 is adjacent to the rear wall 15. The second protrusion 22 is inclined with respect to a direction along which the left wall 13 and the right wall 14 extend (the direction of the arrow x) by a predetermined angle A. The angle A is in a range of 20° to 60°.

Moreover, the width W3 of the second protrusion 22 (the length in the direction of the arrow y) is in a range of approximately half the width W2 of the body 6*e* of the detecting plate 6 to four fifths of the width W2 ($\frac{1}{2}\cdot W2 \leqq W3 \leqq \frac{4}{5}\cdot W2$). With this, the second protrusion 22 faces the rear end portion of the detecting plate 6 that is stuck on the ink pack 5 via the ink pack 5, and stabilizes the attitude of the detecting plate 6. In addition, most of the second protrusion 22 is positioned on the right half of the detecting plate 6.

That is, the first protrusion 21 is disposed to be more remote from the detection window 19 (the detection projection 50) than the second protrusion 22 in the lateral direction of the case 2 (in the direction of the arrow y). With these supporting points (the protrusions 21 and 22) located at different positions in the direction of the arrow y, the attitude of the detecting plate 6, in particular, in the direction of the arrow y can be stabilized. Moreover, when the ink level becomes low, the front right portion 6*r* of the detecting plate 6, i.e., the portion having the detection projection 50 can be easily inclined toward the detection window 19 of the case 2.

Moreover, as shown in FIG. 1, a part of the bottom surface 12*a* of the case 2 adjacent to the rear wall 15 is inclined so as to form a sloping portion 23 for stabilizing the attitude of the ink pack 5. The sloping portion 23 is inclined from the upper end of the rear wall 15 to the bottom surface 12*a* so as to support the rear end portion 5*c* of the ink pack 5.

Figure 5:
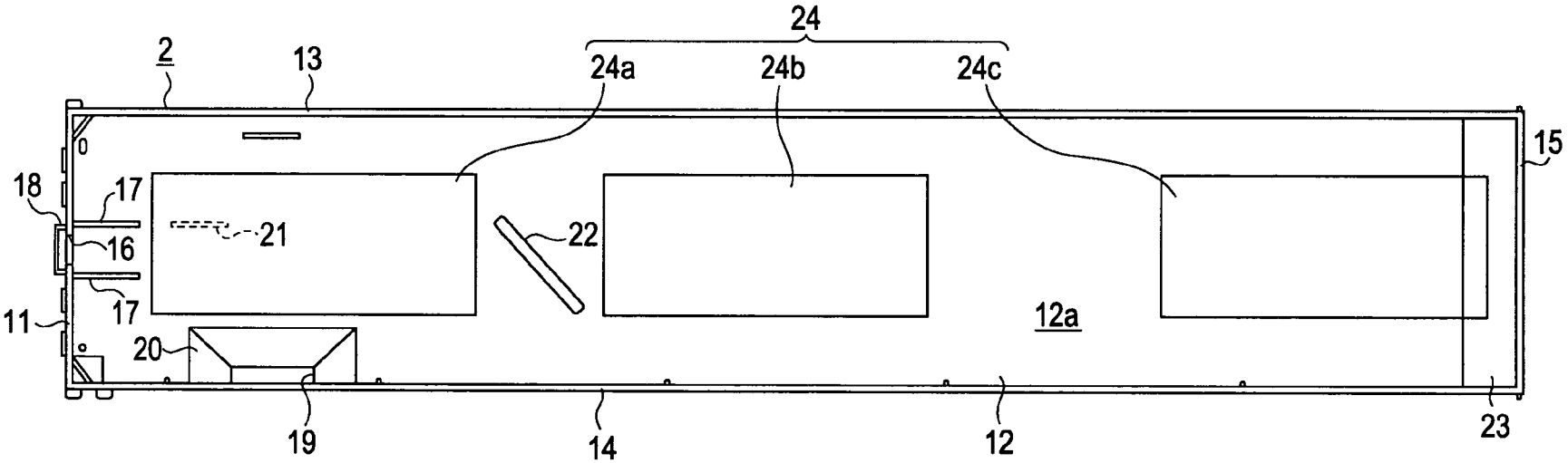
FIG. 5 is a plan view of the case having double-sided adhesive tape pieces stuck thereon.

As shown in FIG. 5, double-sided adhesive tape pieces 24 (adhesive portions) for fixing the ink pack 5 are stuck on the bottom surface 12*a* of the case 2 having the above-described structure. In this embodiment, three pieces of double-sided adhesive tape are stuck on the bottom surface 12*a*. A first double-sided adhesive tape piece 24*a* is disposed at a position between the first supporting portions 17 and the second protrusion 22 from above the first protrusion 21. A second double-sided adhesive tape piece 24*b* is disposed to be more adjacent to the rear wall 15 than the second protrusion 22. A third double-sided adhesive tape piece 24*c* is disposed to be most adjacent to the rear wall 15, and is partly located on the sloping portion 23.

The ink pack 5 is positioned with respect to the case 2 by inserting the supply port 31 of the ink pack 5 into the through-hole 16 of the case 2, and then fixed to the case 2 by sticking the lower surface 5*b* of the ink pack 5 on the bottom surface 12*a* of the case 2 using the double-sided adhesive tape pieces 24*a* to 24*c*.

These three separate tape pieces stuck on the bottom surface 12*a* allow greater clearance for the flexible film F (see FIGS. 1 and 2) of the ink pack 5 and more ably prevent the formation of creases in the bag portion 30 of the ink pack 5 when the ink pack 5 is fixed to the case 2 compared with a case in which only one piece of tape is used. Thus, interruption of the ink flow or interruption of transfer of the detecting plate 6 caused by the creases can be prevented. Moreover, the three double-sided adhesive tape pieces 24 can ensure sufficient adhesive strength.

When the ink pack 5 having the detecting plate 6 stuck thereon at a predetermined position using the double-sided adhesive tape piece 25 is accommodated in the case 2 as described above, about half the first protrusion 21 is located below (i.e., in the z-direction) the detecting plate 6 via the ink pack 5 as shown in FIG. 2. Moreover, the entire second protrusion 22 is located below the detecting plate 6. After the ink pack 5 is accommodated in the case 2 in this manner, the cover 3 is attached to the opening of the case 2.

Figure 6:
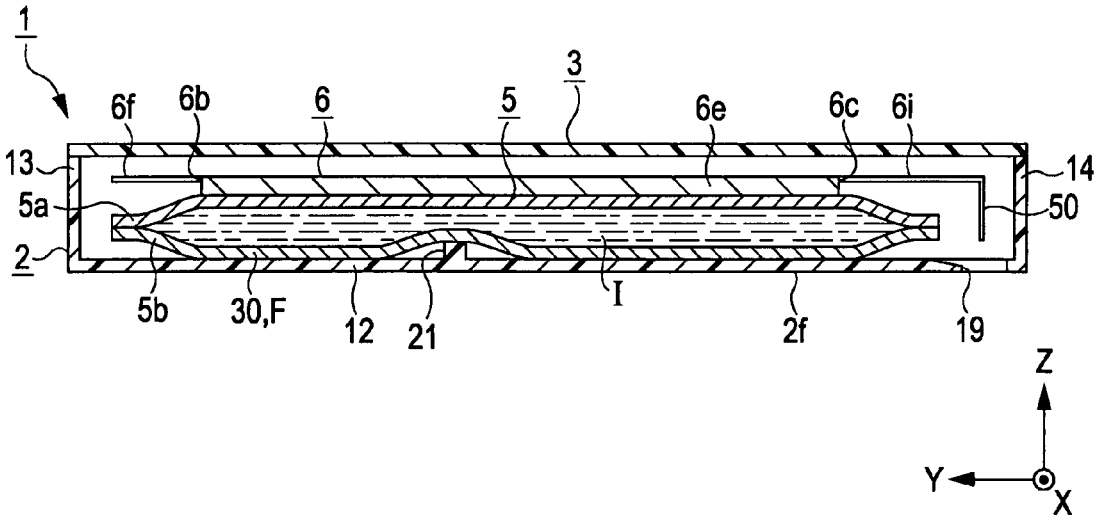
FIG. 6 is a cross-sectional view of a first principal part of the cartridge.
Figure 7:
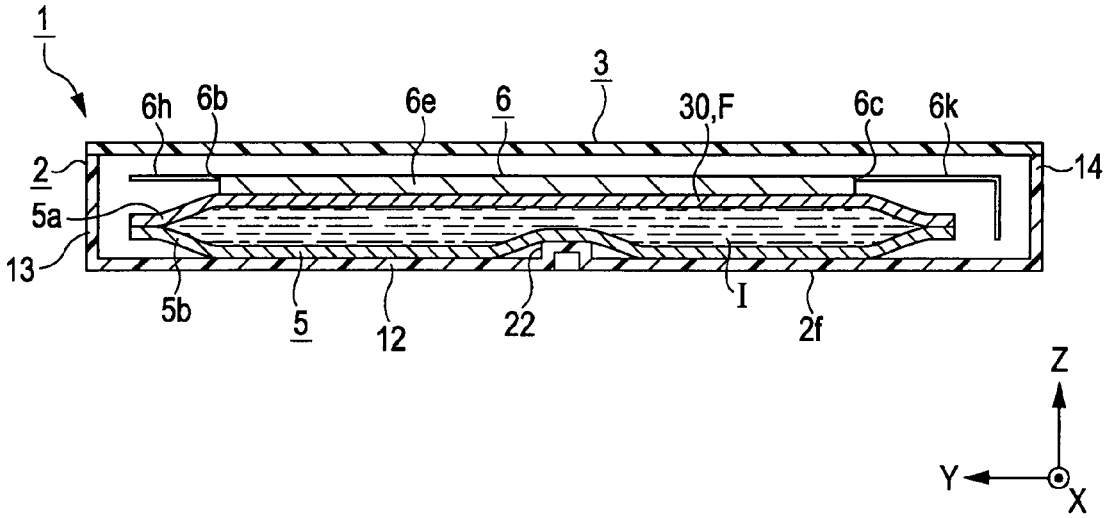
FIG. 7 is a cross-sectional view of a second principal part of the cartridge.

FIGS. 6 and 7 are cross-sectional views of the cartridge 1 assembled as described above taken along lines A-A and B-B, respectively, in FIG. 2. As shown in FIGS. 6 and 7, the ink pack 5 is slightly warped by the first protrusion 21 and the second protrusion 22 formed on the case 2.

The cartridge 1 having the above-described structure is installed in a cartridge holder of the printer, and an ink needle (not shown) communicating with the ink-supplying path is inserted into the supply port 31. Then, ink I is supplied from the ink needle to the ejecting head via the ink-supplying path (both not shown). The ejecting head discharges the ink I for printing, and the ink I inside the ink pack 5 is consumed during printing.

As the ink I inside the ink pack 5 is consumed, the bag portion 30 gradually collapses in the direction opposite to the direction of the arrow z in FIGS. 6 and 7. Moreover, as the bag portion 30 is compressed in the direction opposite to the direction of the arrow z, the detecting plate 6 stuck on the upper surface 5*a* of the ink pack 5 approaches the bottom surface 12*a* of the case 2 in the direction opposite to the direction of the arrow z.

Figure 8:
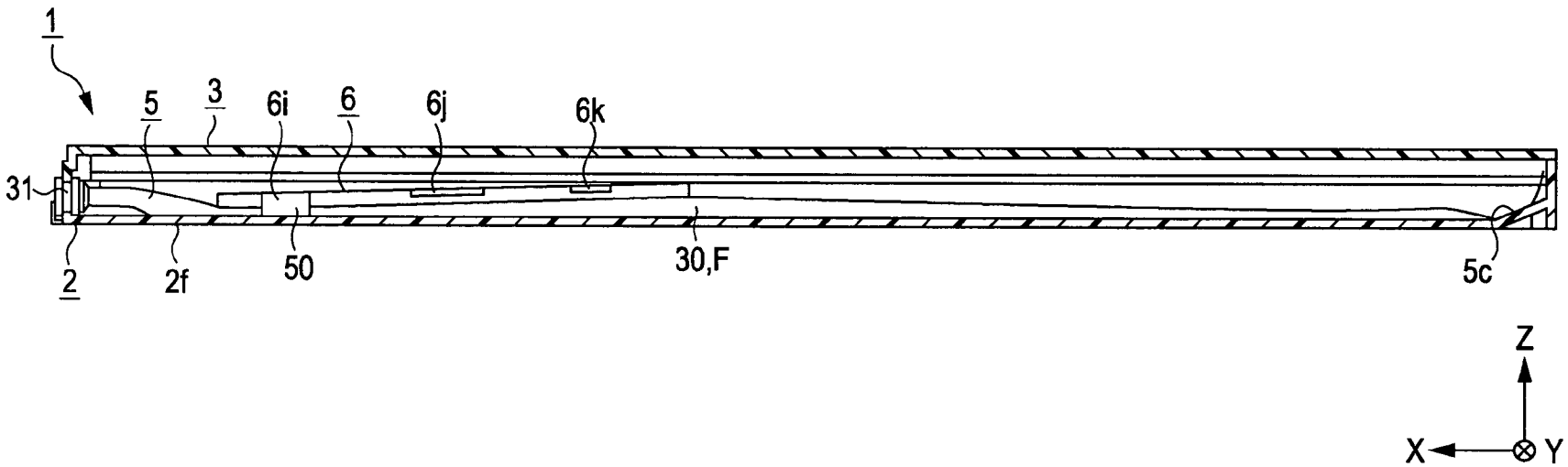
FIG. 8 is a longitudinal sectional view of the cartridge during an out-of-ink state.
Figure 9:
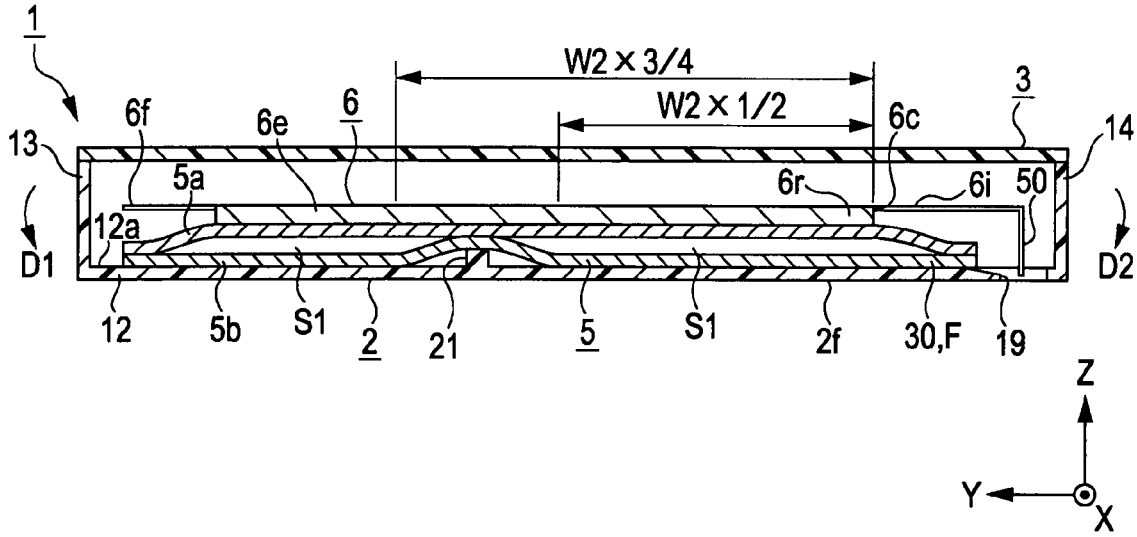
FIG. 9 is a cross-sectional view of the first principal part of the cartridge during the out-of-ink state.
Figure 10:
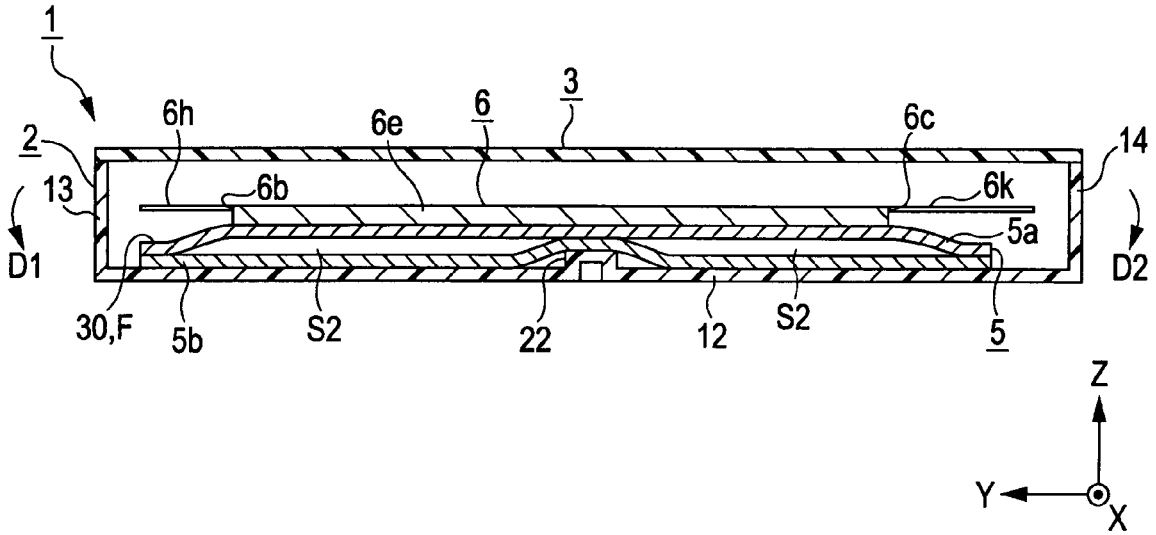
FIGS. 10 is a cross-sectional view of the second principal part of the cartridge during the out-of-ink state.
Figure 11:
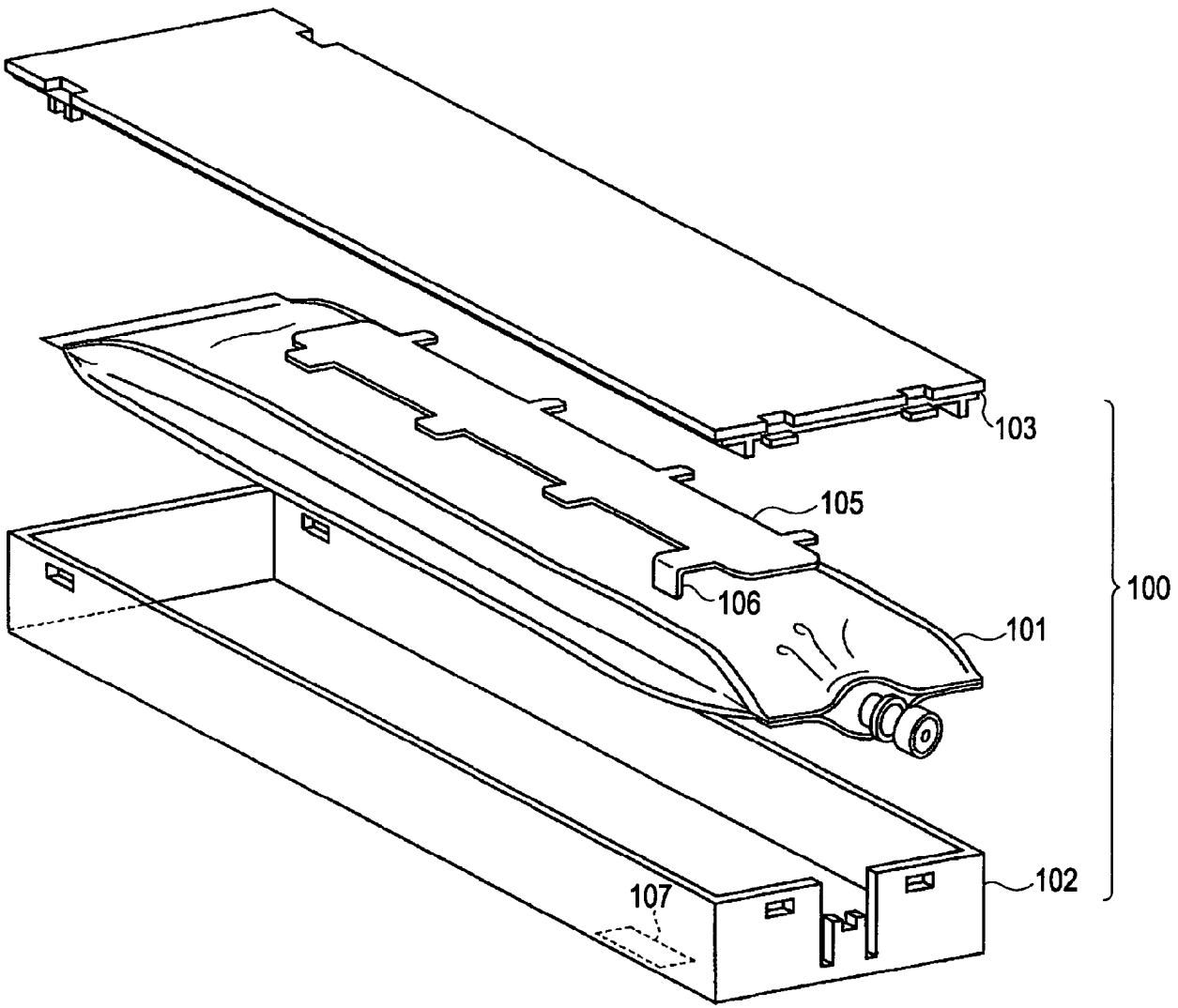
FIG. 11 is an exploded perspective view of a slender cartridge according to a conventional technology.

When the ink level (amount of remaining liquid) inside the bag portion 30 becomes low, the bag portion 30 becomes compressed as shown in FIG. 8. FIGS. 9 and 10 are cross-sectional views taken along lines A-A and B-B (see FIG. 2), respectively, when the ink level is low.

As shown in FIGS. 9 and 10, the detecting plate 6 is supported by the first protrusion 21 and the second protrusion 22 of the case 2 via the bag portion 30, which regulates the transfer of the bag portion 30 toward the bottom surface 12*a* in a direction along which the ink pack 5 collapses. The lower surface 5*b* of the ink pack 5 is partly raised in the direction of the arrow z along the profile of the first protrusion 21, and portions of the lower surface 5*b* around the first protrusion 21 are fixed to the bottom surface 12*a* of the case 2 using the first double-sided adhesive tape piece 24*a* (not shown in FIG. 9). At this time, due to the detecting plate 6 stuck on the upper surface 5*a* of the ink pack 5, the portion having the detecting plate 6 is not deformed, and first spaces S1 are formed inside the ink pack 5. The first spaces S1 have substantially the same height as the first protrusion 21.

Moreover, as shown in FIG. 10, the lower surface 5*b* of the ink pack 5 is partly raised in the direction of the arrow z along the profile of the second protrusion 22. Moreover, the detecting plate 6 is supported by the second protrusion 22 via the bag portion 30, which regulates the transfer of the bag portion 30 toward the bottom surface 12*a* (in the direction opposite to the direction of the arrow z). Furthermore, due to the detecting plate 6 stuck on the upper surface 5*a* of the ink pack 5, the portion having the detecting plate 6 is not deformed downward. Thus, second spaces S2 are formed inside the ink pack 5. The second spaces S2 have substantially the same height as the second protrusion 22.

Thus, even when the ink level inside the ink pack 5 becomes low, the ink I inside the ink pack 5 can be guided to the supply port 31 via the first spaces S1 and the second spaces S2 inside the ink pack 5. Since the detecting plate 6 is supported by the first protrusion 21 and the second protrusion 22, the detecting plate 6 is slightly inclined toward the first protrusion 21 that is shorter than the second protrusion 22, and its attitude is stably maintained without the detection plate extremely leaning toward the left wall 13 or the right wall 14.

When the ink I is further consumed and the ink level reaches a predetermined value or lower (out-of-ink state; liquid-exhausted state), the entire ink pack 5 is compressed while the position of the detecting plate 6 is not changed. As a result, the front right portion 6*r* of the detecting plate 6 is inclined downward, and the detection projection 50 of the detecting plate 6 is fitted into the detection window 19 of the case 2 so as to protrude from the lower surface 2*f* of the case 2. The protruding detection projection 50 comes into contact with a contact portion of a detecting device (not shown) disposed under the case 2 inside the printer. That is, the first protrusion 21 and the second protrusion 22 disposed at the above-described positions facilitate the inclination of the front right portion 6*r* of the detecting plate 6 during an out-of-ink state, and can reliably lead the detection projection 50 to pass through the detection window 19.

In other words, if the first protrusion 21 is disposed at a position remote from the right end 6*c* of the detecting plate 6 by a distance smaller than or equal to half the width W2 of the body 6*e* of the detecting plate 6, i.e., more adjacent to the detection projection 50 than the position according to this embodiment, the detecting plate 6 can be inclined in a D1 direction (toward the left wall 13) shown in FIG. 9 more easily. This prevents the right portion (adjacent to the detection projection 50) of the detecting plate 6 from moving downward even when the ink level reaches a predetermined value or lower, and prevents the detection projection 50 from reaching the detecting device. Thus, an out-of-ink state cannot be detected.

Moreover, if the first protrusion 21 is disposed at a position remote from the right end 6*c* by a distance larger than three fourths of the width W2 of the detecting plate 6, the length of the right portion (adjacent to the detection projection 50) of the detecting plate 6 with respect to the first protrusion 21 becomes large, resulting in the detecting plate 6 becoming unbalanced. This leads the detecting plate 6 to be inclined in a D2 direction shown in FIG. 9 even when the ink level is higher than a predetermined value, and an out-of-ink state is detected even when sufficient ink remains.

Moreover, most of the second protrusion 22 is positioned on the right half of the body 6*e* as described above. If half or more of the second protrusion 22 is located outside the right half, the detecting plate 6 is inclined in the D2 direction shown in FIG. 10, and an out-of-ink state is detected even when the ink level is higher than a predetermined value.

Furthermore, if the second protrusion 22 is shorter than the above-described length ($\frac{1}{2}\cdot W2 \leqq W3 \leqq \frac{4}{5}\cdot W2$), a contact area between the second protrusion 22 and the detecting plate 6 via the ink pack 5 becomes small, and the detecting plate 6 can be inclined in the D1 or D2 direction more easily. If the detecting plate 6 is inclined in the D1 direction, detection failure occurs. If the detecting plate 6 is inclined in the D2 direction, the detection projection 50 is brought into contact with the detecting device even when the level of the ink remaining in the ink pack 5 is higher than a predetermined value. Moreover, if the second protrusion 22 is longer than the predetermined length, the second protrusion 22 occupies a larger area in the direction of the arrow y, resulting in a reduction in the second spaces S2 inside the ink pack 5 in the direction of the arrow y.

When the detection projection 50 of the detecting plate 6 comes into contact with the detecting device, the detecting device outputs a signal indicating that an out-of-ink state is detected. Then, the printer outputs a notification of an out-of-ink state on, for example, a display of the printer so as to urge operators to change the cartridge 1.

According to the above-described embodiment, the following effects can be obtained.

In the above-described embodiment, the first protrusion 21 and the second protrusion 22 for regulating the transfer of the detecting plate 6 in a direction along which the ink pack 5 is compressed when the amount of the ink I becomes small are disposed on the bottom surface 12*a* of the case 2. With this, when the ink pack 5 having a small amount of remaining ink is further compressed by a change in the internal pressure or a load of the detecting plate 6, the ink I can flow via the spaces S1 and S2 formed by the first protrusion 21 and the second protrusion 22, respectively, and can be discharged from the supply port 31. Thus, an out-of-ink state can be appropriately detected when the ink level in the ink pack 5 reaches a predetermined value or lower. This can improve accuracy of detection. Moreover, since the spaces S1 and S2 are maintained even when the ink pack 5 is compressed, the amount of ink discharged from the supply port 31 of the ink pack 5 can be increased, and the wastage rate of ink I can be reduced.

In the above-described embodiment, two protrusions, i.e., the first protrusion 21 and the second protrusion 22, are formed on the bottom surface 12*a* of the case 2. Therefore, in the case of the slender cartridge 1, the attitude of the detecting plate 6, which has a relatively slender shape, can be stabilized using the plurality of supporting points. With this, inclination of the detecting plate 6 when the ink level is high, which hinders the flow of the ink I in the ink pack 5, can be prevented.

In the above-described embodiment, the detecting plate 6 includes the detection projection 50 for detecting an out-of-ink state. Moreover, the first protrusion 21 is located at a position relatively adjacent to the detection projection 50 in the longitudinal direction of the case 2 and remote from the detection projection 50 in the lateral direction of the case 2 under the detecting plate 6. Moreover, the second protrusion 22 is located at a position remote from the detection projection 50 in the longitudinal direction of the case 2 and adjacent to the detection projection 50 in the lateral direction. With this, the attitude of the detecting plate 6 can be stabilized until the ink is exhausted, and the front right portion 6*r* of the detecting plate 6 can be inclined when the ink level reaches a predetermined value or lower such that an out-of-ink state can be reliably detected.

In the above-described embodiment, the first protrusion 21 is located at a position remote from the right end 6*c* of the body 6*e* of the detecting plate 6, the detection projection 50 being formed on the right end 6*c*, by a distance larger than half the width W2 of the body 6*e* and smaller than or equal to three fourths of the width W2 of the body. With this, detection of an out-of-ink state when the ink level is high and detection failure when the ink level reaches a predetermined value or lower can be prevented.

In the above-described embodiment, the width W3 of the second protrusion 22 is in a range of half the width W2 of the body 6*e* of the detecting plate 6 to four fifths of the width W2. Thus, detection of an out-of-ink state when the ink level is high can be prevented. Moreover, detection failure of an out-of-ink state when the ink level reaches a predetermined value or lower can be prevented.

In the above-described embodiment, the second protrusion 22 is inclined with respect to the lateral direction of the case 2. Moreover, the right end 22*b* of the second protrusion 22 is more adjacent to the detection projection 50 than the left end 22*a* in the lateral direction of the case 2, and the left end 22*a* is more adjacent to the supply port 31 of the ink pack 5 than the right end 22*b* in the longitudinal direction of the case 2. With this, the front right portion 6*r* of the detecting plate 6 can be easily inclined such that the detection projection 50 reliably protrudes from the detection window 19 when the amount of the ink I inside the ink pack 5 reaches a predetermined value or lower.

In the above-described embodiment, the height of the first protrusion 21 is smaller than that of the second protrusion 22. Thus, the portion supported by the first protrusion 21, i.e., the front right portion 6*r* of the detecting plate 6, can be inclined such that the detection projection 50 reliably protrudes to the exterior when the ink is exhausted.

In the above-described embodiment, the length of the detecting plate 6 is in a range of a quarter to half the length of the ink pack 5. That is, the attitude of the detecting plate 6 can be stabilized by regulating the length of the detecting plate 6 so as to be equal to up to half the length of the ink pack 5 even when the ink pack 5 has a slender shape. Moreover, the ink pack 5 is not partly compressed by the detecting plate 6 by setting the length of the detecting plate 6 to a quarter or more of the length of the ink pack 5.

In the above-described embodiment, three separate double-sided adhesive tape pieces 24*a* to 24*c* are stuck on the bottom surface 12*a* of the case 2. This prevents the formation of creases when the ink pack 5 is stuck on the bottom surface 12*a*, and improves adhesive strength.

The above-described embodiment can be modified as follows.

In the above-described embodiment, the cartridge 1 is disposed such that the cover 3 faces sideward. However, the orientation of the cartridge 1 is not limited, and the cartridge 1 can be disposed such that the cover 3 faces upward. Moreover, the cartridge 1 can be disposed above or below the ejecting head in the vertical direction.

The transfer of the detecting plate 6 can be regulated by a protrusion formed on the case 2. Moreover, three or more protrusions can be formed on the case 2.

The positions of the first protrusion 21 and the second protrusion 22 can be changed according to the structure of the detecting plate 6. That is, the protrusions 21 and 22 can be disposed any positions as long as the transfer of the detecting plate 6 can be regulated and the detection projection 50 can protrude to the exterior when the level of the ink I reaches a predetermined value or lower.

The width W3 of the second protrusion 22 can be changed according to the sizes of the ink pack 5 and the detecting plate 6. The second protrusion 22 can be disposed substantially parallel to the direction of the arrow x or the direction of the arrow y according to the shape of the detecting plate 6.

The heights of the first protrusion 21 and the second protrusion 22 can be changed according to the position of the detection projection 50, the shape of the case 2, and the like. The length of the detecting plate 6 can be changed from that described above.

The first double-sided adhesive tape piece 24*a* can be disposed between the first protrusion 21 and the second protrusion 22. In the above-described embodiment, three separate double-sided adhesive tape pieces 24 are stuck on the bottom wall 12 of the case 2. Preferably, two to four separate tape pieces are used for preventing the formation of creases in the ink pack 5 and for maintaining sufficient adhesive strength. However, a double-sided adhesive tape piece having substantially the same length as the case 2 can be used according to the shape of the case 2 and the like.

In the above-described embodiment, the detecting plate 6 is stuck on the ink pack 5 in accordance with the positioning mark printed on the ink pack 5. However, the detecting plate 6 can be stuck on the ink pack 5 accommodated in the case 2 such that the detection projection 50 faces the detection window 19.

In the above-described embodiment, the first protrusion 21 and the second protrusion 22 are formed on the case 2 of the cartridge 1. However, these components can be formed in the printer at, for example, a bottom surface of a holder installed in the printer and accommodating the ink pack 5. Alternatively, the first protrusion 21 and the second protrusion 22 can be formed on the cartridge holder, and through-holes through which the first protrusion 21 and the second protrusion 22 pass can be formed in the case 2 of the cartridge 1. When the cartridge is installed in this cartridge holder, the first protrusion 21 and the second protrusion 22 come into contact with the ink pack 5 via the through-holes.

In the above-described embodiment, the cartridge 1 on which first protrusion 21 and the second protrusion 22 are formed has a slender shape. However, the cartridge 1 can have other shapes. In the above-described embodiment, a printer (a printing apparatus including facsimiles, copiers, and the like) that ejects ink is described as the liquid-ejecting apparatus. However, the liquid-ejecting apparatus includes other apparatuses that eject liquid other than ink. For example, the liquid-ejecting apparatus includes apparatuses that eject liquid of electrode materials or color materials used for, for example, manufacturing liquid-crystal displays, electroluminescent (EL) displays, or surface-emitting displays; apparatuses that eject bioorganic substances used for manufacturing biochips; and apparatuses serving as precision pipettes that eject samples.

What is claimed is:

1. A liquid container comprising:

a liquid-containing bag filled with liquid and having a supply port that discharges the liquid;

an outer frame accommodating the liquid-containing bag;

a detecting plate fixed on the liquid-containing bag for detection of a liquid-exhausted state, the detecting plate extending from a front end to a rear end, the front end being disposed closer to the supply port than the rear end; and at least one protrusion disposed on the outer frame at a distance approximately greater than or equal to half a length of the detecting plate from the front end of the detecting plate, wherein the protrusion regulates transfer of the detecting plate in a direction along which the liquid-containing bag is compressed such that the detecting plate is inclined with respect to the outer frame when the amount of the liquid remaining in the liquid-containing bag becomes small, and ensures a space through which the liquid can flow in the liquid-containing bag when the amount of the liquid remaining in the liquid-containing bag becomes small.

2. The liquid container according to claim 1, wherein the protrusion includes a first protrusion and a second protrusion.

3. The liquid container according to claim 2, wherein the detecting plate includes a detection projection that protrudes to the exterior of the outer frame via a window formed in the outer frame according to the inclination of the detecting plate when the liquid-containing bag is in the liquid-exhausted state;

the first protrusion is more adjacent to the detection projection than the second protrusion in a first direction substantially parallel to a side end of a fixed portion of the detecting plate fixed on the liquid-containing bag, the side end having the detection projection; and the second protrusion is more adjacent to the detection projection than the first protrusion in a second direction substantially orthogonal to the first direction.

4. The liquid container according to claim 3, wherein the first protrusion is located at a position remote from the side end of the fixed portion of the detecting plate by a distance larger than half the width of the fixed portion and smaller than or equal to three fourths of the width of the fixed portion.

5. The liquid container according to claim 3, wherein the width of the second protrusion projected in the second direction is in a range of half the width of the fixed portion of the detecting plate to four fifths of the width of the fixed portion.

6. The liquid container according to claim 3, wherein the second protrusion is inclined with respect to the second direction such that a first end of the second protrusion is more adjacent to the supply port of the liquid-containing bag than a second end of the second protrusion in the first direction and such that the second end is more adjacent to the detection projection than the first end in the second direction.

7. The liquid container according to claim 3, wherein the height of the first protrusion is smaller than the height of the second protrusion.

8. The liquid container according to claim 3, wherein the first protrusion is disposed to be more remote from the detection window than the second protrusion in a lateral direction of the outer frame.

9. The liquid container according to claim 2, wherein the second protrusion is located at a position remote from a front end of the detecting plate by a distance approximately larger than half of a length of the detecting plate, and approximately smaller than or equal to the length of the detecting plate.

10. The liquid container according to claim 2, wherein the second protrusion is inclined with respect to a first direction substantially parallel to a side end of a fixed portion of the detecting plate by a predetermined angle A, wherein the angle A is in a range of approximately 20° to approximately 60°.

11. The liquid container according to claim 1, wherein the length of the detecting plate is in a range of a quarter to half the length of the liquid-containing bag.

12. The liquid container according to claim 1, further comprising:

adhesive portions disposed on the outer frame for fixing the liquid-containing bag.

13. The liquid container according to claim 12, wherein the liquid container includes two to four adhesive portions.

14. The liquid container according to claim 1, wherein said outer frame has a bottom surface and said at least one protrusion protrudes from said bottom surface of said outer frame, wherein the protrusion regulates transfer of the detecting plate in a direction toward said bottom surface of said outer frame.

15. The liquid container according to claim 1, wherein the protrusion is disposed so as to face the detecting plate via the liquid-containing bag.

16. The liquid container according to claim 1, wherein the at least one protrusion protrudes from a bottom surface of the outer frame.

17. A liquid-ejecting apparatus comprising:

an ejecting head for ejecting liquid;

a liquid-supplying path for supplying the liquid contained in a liquid-containing bag to the ejecting head, a detecting plate being fixed on the liquid-containing bag for detection of a liquid-exhausted state; and at least one protrusion disposed at a position where the liquid-containing bag is installed the at least one protrusion disposed at a distance approximately greater than or equal to half a length of the detecting plate from a front end of the detecting plate, wherein the liquid-containing bag is disposed between the detecting plate and the at least one protrusion, and the protrusion regulates transfer of the detecting plate in a direction along which the liquid-containing bag is compressed when the amount of the liquid remaining in the liquid-containing bag becomes small, and ensures a space through which the liquid can flow in the liquid-containing bag.

18. The liquid ejecting apparatus according to claim 17, wherein the protrusion is disposed so as to face the detecting plate via the liquid-containing bag.

19. The liquid ejecting apparatus according to claim 17, wherein the at least one protrusion protrudes in a direction along which the liquid-containing bag is compressed when the amount of the liquid remaining in the liquid-containing bag becomes small.

* * * * *